US007316399B2

(12) United States Patent
Shaw et al.

(10) Patent No.: US 7,316,399 B2
(45) Date of Patent: Jan. 8, 2008

(54) FLEXIBLE MAGNETIC DART BOARD WITH THE CAPABILITY OF AUTOMATIC SCORING

(76) Inventors: Jiajiu Shaw, 3166 Shamrock Ct., Ann Arbor, MI (US) 48105; Chia-Mu Shao, 107-1, Sec.2, Fu-Hsing Rd. Taichung, Taiwan (CN)

( * ) Notice: Subject to any disclaimer, the term of this patent is extended or adjusted under 35 U.S.C. 154(b) by 302 days.

(21) Appl. No.: 10/930,410

(22) Filed: Aug. 31, 2004

(65) Prior Publication Data

US 2005/0167926 A1 Aug. 4, 2005

Related U.S. Application Data

(60) Provisional application No. 60/541,381, filed on Feb. 2, 2004.

(51) Int. Cl.
*F41J 3/00* (2006.01)

(52) U.S. Cl. ..... 273/371; 273/348.3

(58) Field of Classification Search ..... 273/348.3, 273/371

See application file for complete search history.

(56) References Cited

U.S. PATENT DOCUMENTS 3,454,276 A * 7/1969 Deming et al. ..... 273/376
4,768,789 A * 9/1988 Clark ..... 273/371
5,462,283 A * 10/1995 Allen ..... 273/371
5,613,684 A * 3/1997 Gittens et al. ..... 273/348.3
5,662,333 A * 9/1997 Allen ..... 273/371
5,775,694 A * 7/1998 Jonsson ..... 273/348.3
5,967,520 A * 10/1999 Chen ..... 273/348.3
6,155,570 A * 12/2000 Allison et al. ..... 273/373
6,439,576 B1 * 8/2002 Montague ..... 273/371
6,517,075 B1 * 2/2003 Yoon ..... 273/348.3

FOREIGN PATENT DOCUMENTS

EP 000977004 A2 * 2/2000
GB 2086243 * 11/1980
GB 2342053 * 4/2000
GB 2342592 * 4/2000

* cited by examiner

*Primary Examiner*—John M. Hotaling, II
(74) *Attorney, Agent, or Firm*—Butzel Long

(57) ABSTRACT

A magnetic dart board that includes embedded conductor coils beneath scoring areas. When a dart with a magnetic head strikes a scoring area of the dart board a current is induced in the underlying conductor coil. The induced current provides an electrical signal that is transmitted to an automatic scoring system that calculates and displays scores. The dart board is made from a plurality of layers including a top layer, an insulating layer, a sensing layer and a body layer. The multi-layered dart board is flexible and can be rolled up for storage, shipping and transportation.

18 Claims, 3 Drawing Sheets

FLEXIBLE MAGNETIC DART BOARD WITH THE CAPABILITY OF AUTOMATIC SCORING

RELATED APPLICATION

The present application is based upon U.S. Provisional Patent Application Ser. No. 60/541,381 entitled "Magnetic Dart Game with the Capability of Automatic Scoring," filed Feb. 2, 2004 to which priority is claim under 35 U.S.C. §120, the entire specification of which is hereby expressly incorporated herein by reference.

TECHNICAL FIELD

The present invention relates to dart games and more specifically to a magnetic dart game having a dart board which includes means for determining the position at which darts contact the dart board and for electronically computing and displaying scores for players during a game of darts.

BACKGROUND ART

Dart games have been in use of a long time. The conventional form of such a dart game employs a dart board that is usually made of cork, paper, or hair, and a plurality of sharp pointed darts. These darts are propelled through the air so that the sharp points of the darts penetrate the dart board.

The sharp points of the darts are not only capable of causing damage to physical objects, but are also capable of causing personal injury. Unfortunately, it is not uncommon for dart-related injuries to include loss of sight from misguided or miss thrown sharp pointed steel darts. More frequently reported injuries include having the sharp points of the darts penetrate other portions of one's body.

Because of the known hazards and potential liability, many retail stores do not even carry and sell dart games which employ sharp pointed darts.

A great number of people enjoy playing darts. However, the safety of people around a dart board is always a concern.

In the past, there have been attempts at designing a dart game in which the sharp points of the darts were eliminated. One such game employs a magnetic dart board with the darts having magnetic heads. However, frequently, the magnetic darts will bounce off of the dart board. Also, the darts frequently move or slide upon the board immediately after initial contact which can substantially change a player's score.

One type of a safer dart board that has emerged in recent years utilizes a dart with a magnetic head which is blunt-ended and therefore poses no danger of puncture wound injury. This dart is used with a dart board that can be flexible or non-flexible that is imbedded with iron to enable the magnetic darts to stick thereto. Once a dart hits the board, it sticks to the board by the magnetic attraction between the magnetic dart head and the iron embedded dart board. Such a dart board does not satisfy sophisticated players because it does not have the capability of automatic scoring.

Another type of prior art dart board employs suction cup darts. Such suction cup type of darts frequently bounce off of the board, and when they do stick to the board they often fall off after a period of time when the suction cup loses vacuum. Otherwise, as the surface of the dart board gets worn and/or the suction cups on the darts get old the darts fail to stick to the board.

U.S. Pat. No. 3,949,989 discloses a bristled dart that is used in conjunction with a spiked dart board.

One advance in the field of dart games is the development of automatic scoring system for dart boards.

Some prior art dart games include a plurality of target areas having normally open switch means that are connected to illuminating means for indicating the strike position of a metal tipped dart which pierces a target area to effect closing of the associated switch means by bridging the same through its metal tip. Such types of dart games are exemplified by U.S. Pat. No. 2,501,218 to Hill and U.S. Pat. No. 2,693,959 to Ross, Jr.

Another type of prior art dart game includes a plurality of target areas having normally open conductive means on their surfaces which are closed by a conductive projectile as it contacts portions of the conductive means and is retained thereby by some force e.g. magnetic or gravity. Such types of dart games are exemplified by U.S. Pat. No. 2,863,665 to Gerosolina and U.S. Pat. No. 3,582,076 to Keller respectively.

Another type of prior art dart game includes means for electrically indicating via illuminating means, the impact area of a projectile which is momentarily impacted against but does not remain against the target area. Such types of dart games are exemplified by U.S. Pat. No. 3,206,196 Jackson and U.S. Pat. No. 1,569,727 to Donato.

U.S. Pat. No. 3,454,276 to Brenkert et al discloses a dart game which utilizes electro-mechanical means for effecting counting sequences in response to successive target area impacts by a dart and indicates the cumulative results of the counting sequences on a display board after each impact. This system utilizes simple arithmetic addition of successive inputs as each dart is impacted against various target areas.

U.S. Pat. No. 4,216,968 to Yeeda discloses a self scoring dart game having electronic means for computing different mathematical functions in response to a series of dart impacts.

A need exists for a dart game wherein sharp pointed darts are eliminated and automatic scoring is provided with in a manner which compensates for darts that strike the dart board, but fail to stick to the dart board or slide on the dart board after landing.

DISCLOSURE OF THE INVENTION

According to various features, characteristics and embodiments of the present invention which will become apparent as the description thereof proceeds, the present invention provides a significant improvement over current magnetic dart games so that it has the capability of automatic scoring.

The present invention provides a self scoring dart game dart game that comprises:

a plurality of darts having magnet heads;

a dart board having a plurality of conductor coils embedded therein which conductor coils are arranged in a pattern that corresponds to predetermined scoring areas, the conductor coils including electrical leads and being configured so that when one of the plurality of darts strikes the dart board over one of the plurality of conductor coils the magnetic head of the dart induces an electrical current in the coil that is transmitted through the coils leads; and an electronic scoring system which receives transmitted electrical currents induced in the plurality of conductor coils and calculates and displays a score from the transmitted currents induced in the plurality of conductor coils.

BRIEF DESCRIPTION OF DRAWINGS

The present invention will be described with reference to the attached drawings which are given as non-limiting examples only, in which.

BEST MODE FOR CARRYING OUT THE INVENTION

The present invention is directed to a magnetic dart game with automatic scoring capability. The magnetic dart game includes a dart board with imbedded conductor coils that are each connected to an external scoring device, blunt-headed magnetic darts, and an external scoring device.

The dart board is made from a plurality of thin layers including a pre-designed pattern of conductor coils that can be printed, sprayed, adhered or otherwise provide on the surface of one of the layers which is referred to herein as the "sensing layer." Each coil is individually wired to an external scoring device.

When the head of the magnetic dart hits the dart board of the present invention, the motion of the magnet head of the dart towards the plane of the dart board in which the conductor coils are embedded induces an induction current in a conductor coil embedded in the dart board below the surface of the board where the magnetic dart strikes the board. In addition, some minor induction currents may be induced in any nearby conductor coil(s). According to the present invention the current that is induced as the magnetic head of a dart strikes the dart board is used to determine the location on the dart board that was struck by a magnetic dart. In the case where minor induction currents are generated by conductor coils that are only near the location when a magnetic dart directly strikes the dart board, the electronic scoring system differentiates between the induced current strengths and determines the location where the dart struck the dart board directly. In addition, because the magnet heads of the darts are able to induce a current in the conductor coils embedded in the dart board, a dart does not have to actually stick to the dart board after it strikes the dart board. Accordingly, the dart game of the present invention can automatically compensate for magnetic dart designs that may not stick to the dart board as readily as a sharp pointed dart might stick to a bristle dart board, or for magnetic dart designs that magnetically stick on a dart board and thereafter slide into a different position.

In order to differentiate between locations that are struck by the magnetic darts, the conductor coils are spaced apart from one another by a distance of from about 0.4 to about 0.6 cm, or such a distance that, depending on the diameter of the magnetic heads on the darts will avoid or limit any single dart strike on the dart board from overlapping two or more conductor coils, or avoid interference between adjacent conductor coils.

The conductor coils which comprise part of the sensing or scoring system of the present invention are individually connected to an external scoring device to automatically keep the score.

Figure 2:
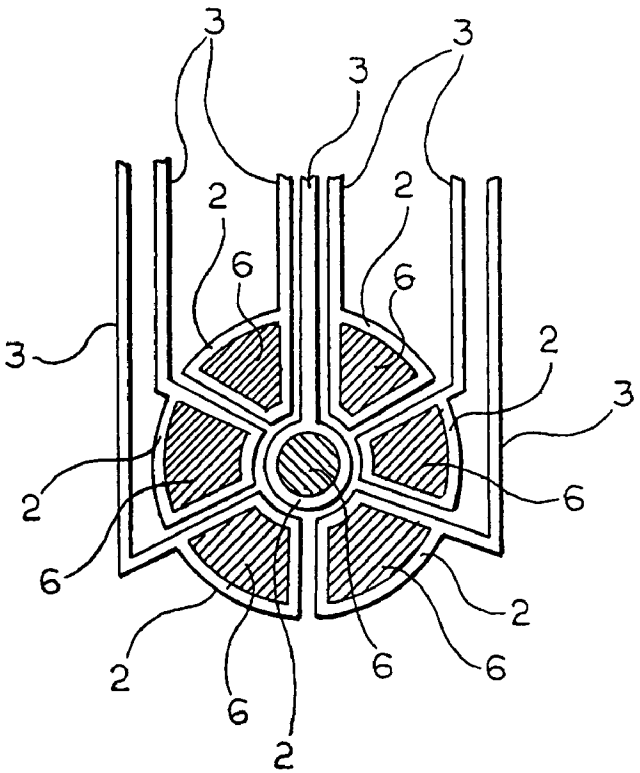
FIG. 2 is a planar view which shows the manner in which the conductor coils of the sensing layer are aligned with the pattern of the magnetic attractive material provided on the bottom later of the dart board.
Figure 1:
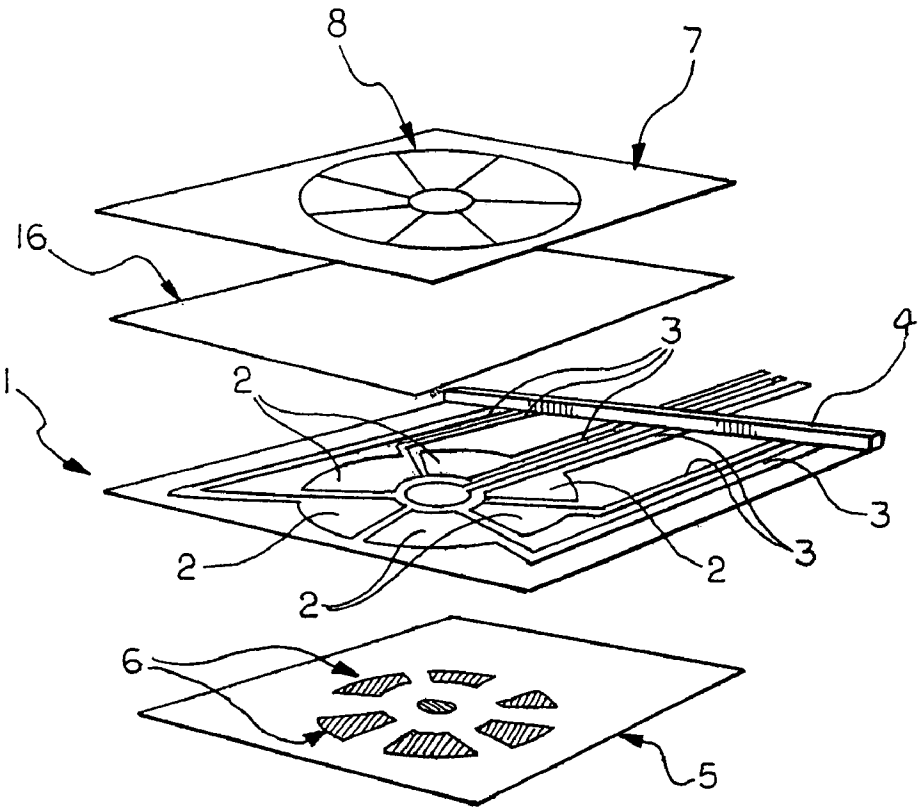
FIG. 1 is an exploded view of a dart board constructed according to one embodiment of the present invention.

FIG. 1 is an exploded view of a dart board constructed according to one embodiment of the present invention. FIG. 2 is a planar view which shows the manner in which the conductor coils of the sensing layer are aligned with the pattern of the magnetic attractive material provided on the bottom later of the dart board.

As shown in FIG. 1 the dart board includes a sensing layer 1 upon which a plurality of conductor coils 2 are provided. As noted above, and depicted in FIGS. 1 and 2, the conductor coils 2 are single looped coils which have leads 3 that extend to one end or side of the sensing layer 1 at which the leads 3 can be coupled to a suitable multi-pin electrical connector 4 by which the conductor coils 2 can be connected to an electronic scoring device (see FIGS. 5 and 6).

The sensing layer 1 used in the dart boards of the present invention can be made from any suitable polymeric material that is capable of withstanding temperature variations that will be generated in the conductor coils 2 as currents are induced in the conductor coils 2. In addition, polymeric materials that are flexible can be used when the dart board is to be constructed so that it can be rolled up for storage, shipping and transportation. Suitable polymeric materials from which to make the sensing layer 1 include thermoplastic polymers is polyethylene terephthalate (PET).

The conductor coils 2 can be a provided on the sensing layer 1 by printing the conductor coils 2 and lead patterns 3 from a conductive paste on the polymeric sensing layer and drying or curing the conductive paste thereafter. Suitable conductive pastes can comprise primarily silver or carbon in a carrier matrix that will cure or set upon heating. Such silver or carbon conductor pastes which are cured or set upon heating to temperatures of between 100 and 150° C., or between 120 and 140° C. have been determined to be particularly suitable for purposes of the present invention.

In addition to printing the conductor coils 2 from conductive pastes, the conductor coils 2 can also be deposited on the sensing layer 1 using metallic plasma techniques together with any suitable masks. Alternatively, the conductor coils 2 can comprise thin metallic films that are laminated or otherwise adhered to the sensing layer 1 using known techniques. Another manner of forming the conductive coils 2 on the sensing layer 1 is to deposit or apply a continuous film of a conductive material to the sensing layer 1 and then etch off portions of the continuous layer using wet or dry etching techniques to leave a desired pattern of the conductive coils 2 with their leads 3.

In order to ensure that the magnetic darts will stick to the dart board, a bottom layer 5 of the dart board is provided with a thin layer of non-magnetic, magnetic-attractive material such as iron or an iron composition. This thin layer of iron or an iron composition 6 is patterned, as shown in FIGS. 1 and 2 to attract the magnet darts to the central portion or areas of the conductor coils 2. In this manner, there is less likelihood that the magnetic head of a dart will stick to the dart board directly over adjacent portions of the conductor coils 2 but rather within the central area of one of the conductor coils 2 over the embedded pattern of the iron or iron composition 6.

The thin layer of iron or an iron composition 6 can comprise a plurality of non-magnetic thin pieces of iron or iron composition. Suitable iron compositions include iron particles combined with various polymeric materials including polymer particles and cross-linked polymer formulations and rubber formulations are known in the art of magnetic game boards.

The bottom layer 5 can be made of any suitable polymeric material which, in combination with the other layers of the dart board, is sufficiently thin and flexible to allow the dart board to be rolled up as noted above. The bottom layer 5 together with the patterned thin layer of iron or an iron composition 6 is referred to herein as a "body layer." According to one embodiment of the present invention the iron or iron composite patterned layer 6 has about the same thickness as the polymeric material of the bottom layer 5 which is about 0.04 cm thick. Although FIG. 1 depicts the bottom layer 5 as being positioned under the sensing layer 1, it is within the scope of the present invention to position the bottom layer 5 above the sensing layer 1.

The dart board includes a top layer 7 that is printed with a predetermined scoring design 8 which can correspond to a standard regulation dart board or to any modified scoring design, it being understood that the pattern, shape and arrangement of the embedded conductor coils 2 will correspond to the scoring design 8. The top layer 7 of the dart board can be made from any suitable polymeric material or, in order to present the look and feel of a more conventional bristle board, from a woven or non-woven fabric upon which the scoring design 8 is printed.

For illustrative purposes, FIGS. 1 and 2 depict a center or "bull's eye" of a scoring design surrounded by an annular arrangement of discrete areas of a scoring design and the corresponding pattern, shape and arrangement of conductor coils 2 and thin layer of iron or iron composition 6.

Figure 3:
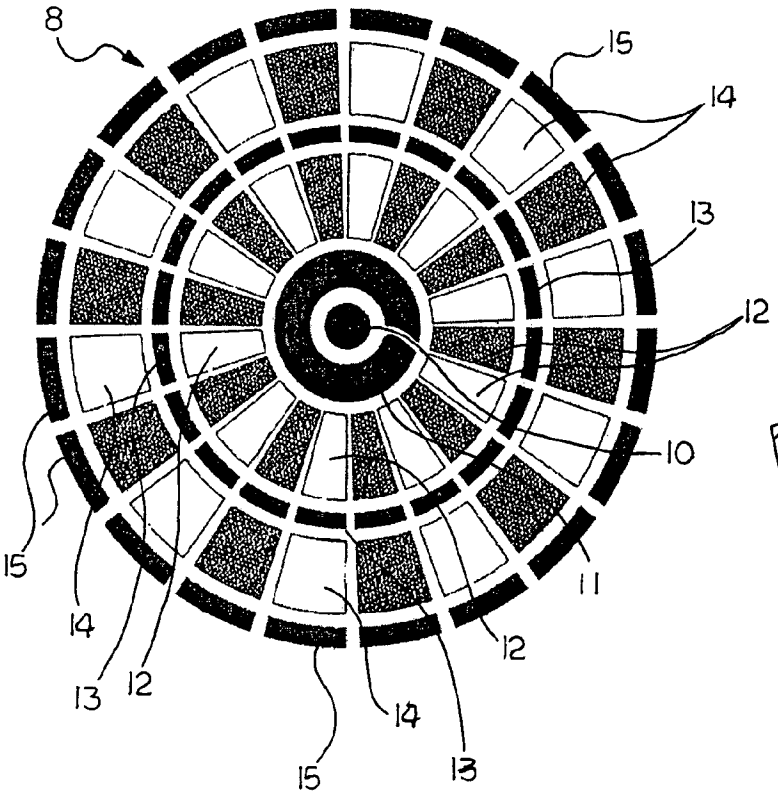
FIG. 3 depicts a standard regulation dart board scoring design

FIG. 3 depicts a standard regulation dart board scoring design 8 which includes a center or "bull's eye" 10, an annular scoring area 11 surrounding the center or "bull's eye" 10, a plurality of radially extending scoring areas 12, 13, 14 and 15 which include and two narrow annular rings of scoring areas 13 and 15 that are radially narrower that the other radially extending scoring areas 12 and 14.

Figure 4:
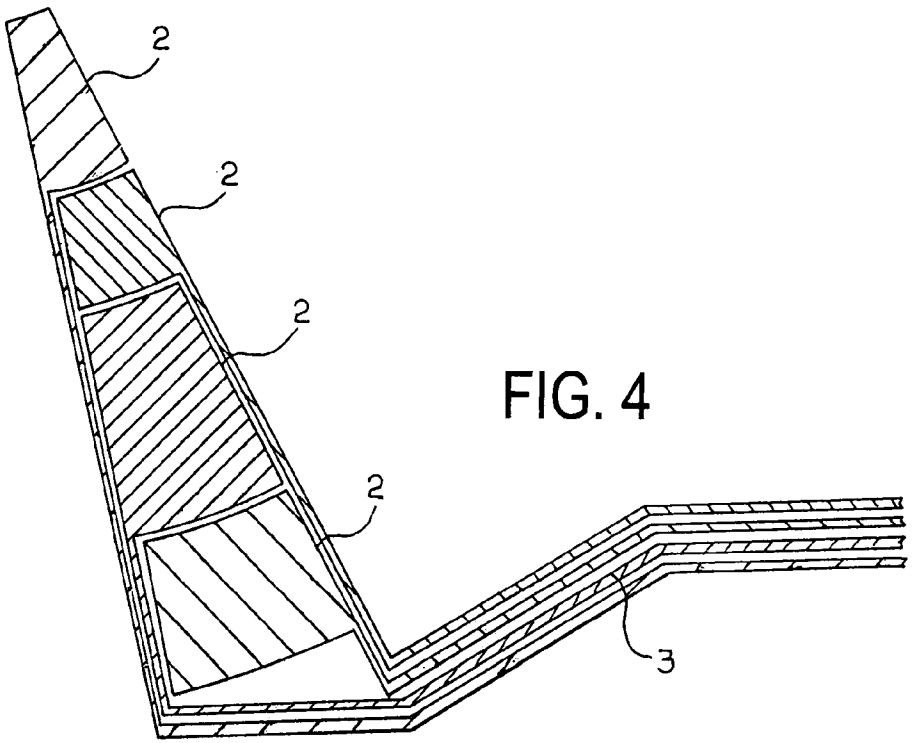
FIG. 4 is an illustration of one manner in which conductor coils could be patterned for the scoring design of FIG. 3

FIG. 4 is an illustration of the manner in which conductor coils 2 would be patterned to correspond to the radially extending scoring areas 12, 13, 14 and 15 of the scoring design 8 shown in FIG. 3, howbeit the widths of the radially extending scoring areas 12, 13, 14 and 15 of FIG. 4 are not drawn to scale. FIG. 4 shows how the individual conductor coils 2 can be shaped and aligned to match a pattern of radially extending scoring areas 12, 13, 14 and 15 and how the leads 3 from the individual conductor coils 2 can be arranged. It is to be understood that other arrangements of the scoring areas and, conductor coils 2 and thin layer of iron or iron composition 6 could be used according to the present invention.

In addition to the sensing layer 1, the body layer, and the top layer 7 an insulating layer 16 can be placed between the top layer 7 and the sensing layer 1, particularly when the top layer 7 comprises a woven or non-woven fabric. The insulating layer 16 can comprise a thin film made from a polymeric material.

Although the dart board according to one embodiment of the present invention is designed and manufactured to be flexible so that it can be rolled up for storage, shipping and transportation, it is also within the scope of the present invention to mount the dart board on a non-flexible support or use a non-flexible support for the bottom layer 5.

Figure 6:
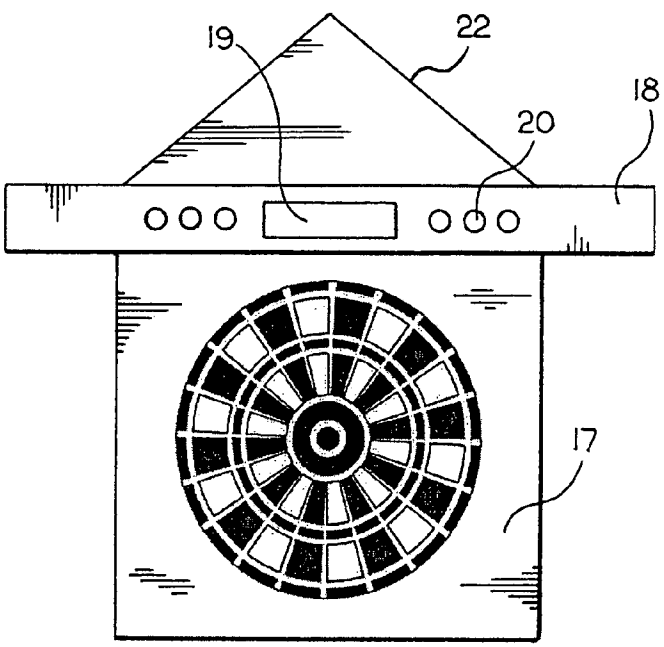
FIG. 6 is a front planar view of the dart board of FIG. 5.
Figure 5:
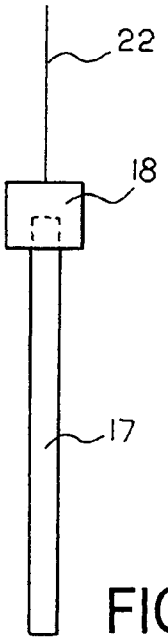
FIG. 5 is a side planar view of a dart board according to one embodiment of the present invention.

FIG. 5 is a front planar view of a dart board according to one embodiment of the present invention. FIG. 6 is a side planar view of the dart board of FIG. 5. The dart board 17 of FIGS. 5 and 6 is a flexible dart board that can be suspended from a narrow electronics housing 18. The electronics housing 18 contains an automatic scoring system and includes a display 19 which displays a player's score during a dart game. In addition the electronics housing may include a display 20 prompting each player as to when it is their turn to throw their darts. The automatic scoring system used and housed in the electronics housing 18 of the present invention can be any one of numerous known automatic scoring systems, modified if necessary to include means for comparing currents induced in adjacent conductor coils and determining the stronger current. The dart board 17 can be suspended by a cord, string or wire 22 that is attached at opposite ends to the electronics housing 18 as shown.

Figure 7:
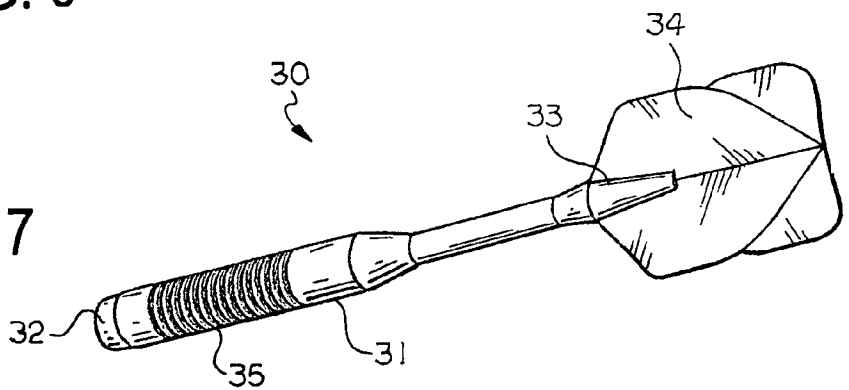
FIG. 7 is a perspective view of a magnetic dart that can be used in conjunction with the dart board of the present invention.

FIG. 7 is a perspective view of a magnetic dart that can be used in conjunction with the dart board of the present invention. The magnetic dart 30 includes a shaft or stem 31 having a magnetic head 32 on one end and flight holder 33 on the opposite end for receiving and holding a flight 34. As shown, the shaft or stem 31 of the magnetic dart 30 can include a gripping area 35 for holding and throwing the dart 30, which gripping area can be configured, e.g., provided with ribs that absorb some of the deceleration of the dart when it strikes the dart board.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and as set forth in the attached claims.

What is claimed is:

1. A self scoring dart game dart game that comprises:

a plurality of darts having magnet heads;

a dart board comprising:

a plurality of conductor coils embedded therein which conductor coils are arranged in a pattern that corresponds to predetermined scoring areas, the conductor coils including electrical leads and being configured so that when one of the plurality of darts strikes the dart board over one of the plurality of conductor coils the magnetic head of the dart induces an electrical current in the coil that is transmitted through the conductor coils leads; and non-magnetic areas of iron or iron composite that are aligned to be within each of the conductor coils and patterned to conform to the predetermined scoring areas; and an electronic scoring system which receives transmitted electrical currents induced in the plurality of conductor coils and calculates and displays a score from the transnuitted currents induced in the plurality of conductor coils, wherein the dart board is flexible and can be rolled up.

2. A self scoring dart game according to claim 1, wherein the dart board comprises a plurality of layers including a sensing layer upon which the plurality of conductor coils are provided.

3. A self scoring dart game according to claim 2, wherein the conductor coils are applied on the sensing layer by at least one of printing, spraying, and adhering the conductor coils on the surface of the sensing layer so that each of the plurality of conductor coils is spaced apart from an adjacent conductor coil.

4. A self scoring dart game according to claim 2 wherein the sensing layer comprises a polymeric material.

5. A self scoring dart game according to claim 4, wherein the sensing layer comprises polyethylene terepthalate.

6. A self scoring dart game according to claim 3, wherein the conductor coils are printed on the sensing layer using a conductive paste.

7. A self scoring dart game according to claim 6, wherein the conductive paste comprises at least one of silver or carbon.

8. A self scoring dart game according to claim 3, wherein the conductor coils are applied on the sensing layer using a metallic plasma.

9. A self scoring dart game according to claim 3 wherein the conductor coils comprise thin metal element that are adhered on the sensing layer.

10. A self scoring dart game according to claim 3, wherein the conductor coils are formed on the sensing later by an etching process.

11. A self scoring dart game according to claim 10, wherein the etching process is one of a wet etching process and a dry etching process.

12. A self scoring dart game according to claim 2, wherein the plurality of layers of the dart board comprises a body layer, said body layer comprising said areas of non-magnetic areas of iron or iron composite that are patterned to be individually aligned with the center areas of each of the plurality of conductor coils.

13. A self scoring dart game according to claim 12, wherein the body layer is positioned under the sensing layer.

14. A self scoring dart game according to claim 12, wherein the body layer is positioned over the sensing layer.

15. A self scoring dart game according to claim 2, wherein the plurality of layers of the dart board comprises a top layer that includes a predetermined scoring design.

16. A self scoring dart game according to claim 15, wherein the top layer comprises one of a woven and a non-woven fabric.

17. A self scoring dart game according to claim 15, further comprising an insulating layer between the top layer and the sensing layer.

18. A self scoring dart game according to claim 2, wherein the plurality of layers of the dart board comprises a bottom layer.

* * * * *